US006219977B1

(12) United States Patent
Chao et al.

(10) Patent No.: US 6,219,977 B1
(45) Date of Patent: Apr. 24, 2001

(54) TUBULAR SKYLIGHT WITH ROUND-TO-SQUARE ADAPTOR

(75) Inventors: Bing-Ling Chao, San Diego; Christian P. Stevens, Carlsbad; Joseph W. Prenn, San Diego, all of CA (US)

(73) Assignee: Solatube International, Inc., Vista, CA (US)

( * ) Notice: Subject to any disclaimer, the term of this patent is extended or adjusted under 35 U.S.C. 154(b) by 0 days.

(21) Appl. No.: 09/305,614

(22) Filed: May 5, 1999

(51) Int. Cl.[7] ..... E04B 7/18
(52) U.S. Cl. ..... 52/200; 52/198
(58) Field of Search ..... 52/200, 198

(56) References Cited

U.S. PATENT DOCUMENTS 5,502,935 * 4/1996 Demmer ..... 52/200
5,896,713 * 4/1999 Chao et al. ..... 52/200

* cited by examiner

*Primary Examiner*—Carl D. Friedman
*Assistant Examiner*—Patrick J. Chavez
(74) *Attorney, Agent, or Firm*—John L. Rogitz

(57) ABSTRACT

A tubular skylight is coupled to rectangular opening of a ceiling support grid by an adaptor. The adaptor includes a ring-shaped tube segment, a rectangular-shaped ceiling segment, and a frustum-shaped intermediate segment connecting the upper segment and ceiling segment.

9 Claims, 1 Drawing Sheet

Fig. 1
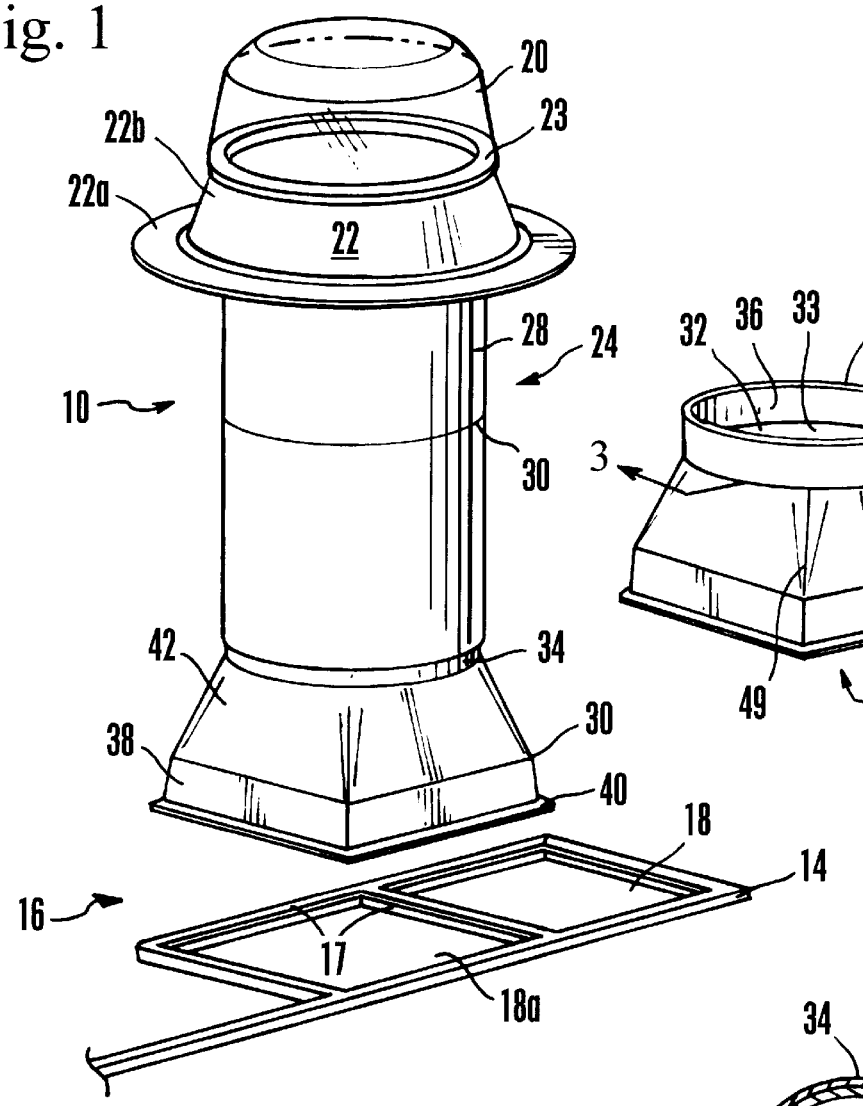
Fig. 2
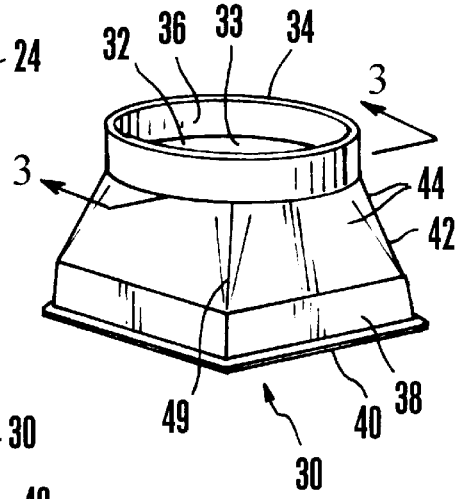
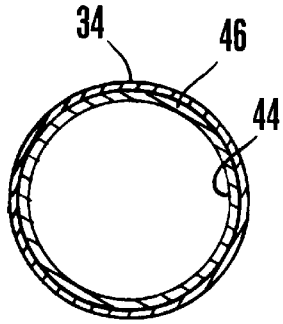
Fig. 3
Fig. 4
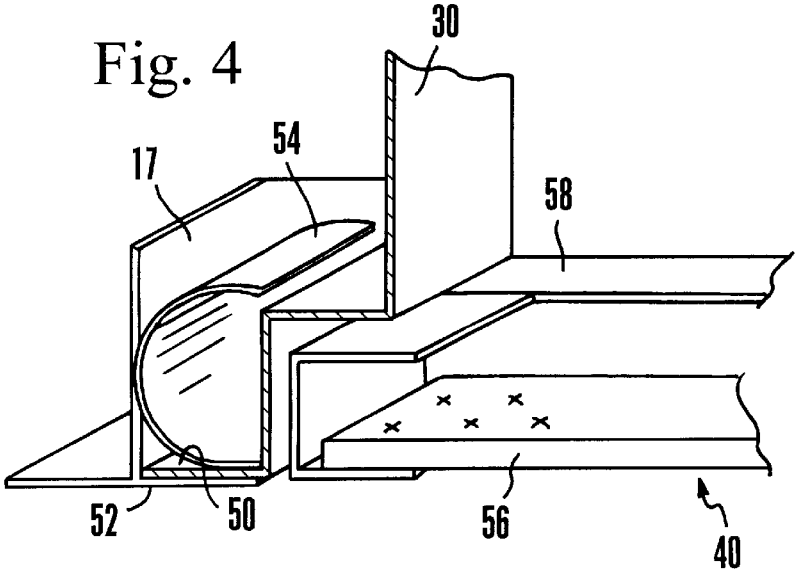

TUBULAR SKYLIGHT WITH ROUND-TO-SQUARE ADAPTOR

FIELD OF THE INVENTION

The present invention relates generally to apparatus for naturally illuminating rooms, and more particularly to tubular skylights.

BACKGROUND

Tubular skylights have been provided for illuminating rooms inside buildings with natural light. Not only do tubular skylights thus save electricity and, concomitantly, are environmentally benign, but they illuminate rooms in a pleasing way using natural sunlight instead of 60 cycle electric light. An example of a commercially successful tubular skylight is disclosed in U.S. Pat. No. 5,099,622, assigned to the same assignee as the present invention and incorporated herein by reference.

A tubular skylight includes a roof-mounted, dome-like transparent cover. The cover is mounted on the roof of a building by means of a flashing. An internally reflective tube depends downwardly from the roof to the ceiling of the room sought to be illuminated, and the bottom of the tube is covered with a disk-shaped light diffuser that is positioned at the ceiling. The round cross-sectional shape of the tube promotes light reflectivity and transmission down the tube, into the building.

In most existing tubular skylights, the ceiling dry wall supports the diffuser and the tube. To install a tubular skylight, a circular hole is cut in the existing ceiling dry wall and another hole is cut in the roof, and then the skylight positioned and mounted as described above.

The present invention recognizes that tubular skylights can be used in applications other than in conventional ceiling dry walls. For example, the present invention recognizes that tubular skylights can be used to illuminate relatively larger buildings that have ceilings defined in part by rectangular grids of metal support joists. The grids are used to support rectangular-shaped ceiling panels.

As understood by the present invention, the bottom portion of a tubular skylight should be shaped complementarily to the ceiling opening with which the skylight is engaged. In the case of conventional ceilings made of dry wall, the ceiling opening is formed to accommodate the round cross-sectional shape of the skylight. In the case of larger ceilings having rectangular support grids, however, the opening with which the skylight must be engaged, namely, one of the rectangular areas formed by the grid, is not designed with tubular skylights in mind, but rather with the rectangular shape of conventional ceiling panels in mind. As intimated above, this problem cannot be solved simply by making the skylight parallelepiped-shaped, because a skylight with a rectangular cross-section will not transmit light down to the ceiling as efficiently as will a tubular skylight. Moreover, the tubular shape of skylights is widely accepted and indeed ingrained in the industry. The present invention has both recognized the problem of installing skylights in a ceiling grid, and provides the below-disclosed solution.

SUMMARY OF THE INVENTION

A tubular skylight is disclosed for a building having a roof with a skylight flashing and at least one ceiling grid below the roof for supporting a ceiling above a room, wherein the ceiling grid defines at least one rectangular opening. In accordance with the present invention, the skylight includes a transparent cover that is engageable with the flashing, and a tube assembly depending downwardly from the flashing. The tube assembly has an upper end covered by the cover. An adaptor couples the tube assembly to the rectangular opening.

In a preferred embodiment, the adaptor is hollow, and the inside surface of the adaptor is covered with a reflective coating. The preferred adaptor defines a ring-shaped tube segment that is configured complementarily to the tube assembly and that is engaged with the tube assembly. Moreover, the adaptor includes a rectangular-shaped ceiling segment that is configured complementarily to the rectangular opening and that is disposed on the grid. A rectangular-shaped light diffuser is coupled to the rectangular-shaped ceiling segment of the adaptor.

As disclosed in detail below with respect to the preferred embodiment, the adaptor is formed with an intermediate segment that is at least partially frusto-pyramidal shaped. The intermediate segment connects the ring-shaped tube segment of the adaptor to the rectangular-shaped ceiling segment of the adaptor. In a particularly preferred embodiment, the intermediate segment includes a lower intermediate portion defining a right regular pyramidal frustum and an upper intermediate portion defining a circular top edge.

In another aspect, an adaptor for interconnecting a tubular skylight and a rectangular-shaped opening of a ceiling grid that has a rectangular-shaped diffuser disposed therein includes a hollow tube segment. As envisioned by the present invention, the tube segment is circular-shaped to facilitate coupling the tube segment to the tubular skylight. Also, the adaptor includes a hollow ceiling segment is rectangular-shaped to facilitate coupling the ceiling segment to the diffuser.

In still another aspect, a method is disclosed for mounting a tubular skylight in a building having a roof and a ceiling grid below the roof. The method includes attaching the skylight to the roof, and disposing a diffuser in an opening of the grid. The tube of the skylight is then coupled to the diffuser.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a perspective view of the tubular skylight of the present invention in an exploded relationship with a ceiling grid, with portions of the ceiling grid cut away for clarity;

FIG. 2 is a perspective view of the square-to-round adaptor;

FIG. 3 is a cross-sectional view as seen along the line 3—3 in FIG. 2; and FIG. 4 is a perspective view showing the details of how the adaptor and diffuser are supported, with portions broken away for clarity.

DESCRIPTION OF THE PREFERRED EMBODIMENT

Referring initially to FIG. 1, a tubular skylight is shown, generally designated 10, for lighting, with natural sunlight, an interior room 12 having a ceiling support grid 14 in a building, generally designated 16. FIG. 1 shows that the grid 14 includes orthogonal metal or plastic T-shaped joists 17 that together define plural rectangular-shaped openings 18.

Each opening 18 can define a two foot by two foot square, although other rectangular shapes and dimensions are contemplated herein. In accordance with the present invention, most of the openings 18 support ceiling panels but one of the openings, designated 18*a* in FIG. 1, can engage the skylight 10.

Describing the skylight 10 from top to bottom, as shown in FIG. 1, the skylight 10 includes a roof-mounted cover 20. The cover 20 is optically transmissive and preferably is transparent. In one embodiment, the cover 20 can be the cover disclosed in co-pending U.S. patent application Ser. No. 08/957,513, filed Oct. 24,1997 for an invention entitled "LIGHT-COLLECTING SKYLIGHT COVER", owned by the same assignee as the present invention. Or, the cover 20 can be other suitable covers, such as the covers marketed under the trade name "Solatube" by the present assignee.

The cover 20 is mounted to the roof of the building 16 by means of a flashing 22. The flashing 22 includes a flange 22*a* that is attached to the roof by means well-known in the art, and a curb 22*b* rises upwardly from the flange 22*a* and is angled relative to the flange 22*a* as appropriate for the cant of the roof to engage and hold the cover 20 in the generally vertically upright orientation shown. A seal 23 can be positioned between the curb 22*b* and the cover 20 to effect a dust and water seal between the cover 20 and the flashing 22.

As further shown in FIG. 1, an internally reflective metal tube assembly 24 is connected to the flashing 22. The tube assembly 24 extends to the grid 14 of the interior room 12, with the top of the tube assembly 24 being covered by the cover. Per the present invention, the tube assembly 24 directs light that enters the tube assembly 24 downwardly into the room 12. The tube assembly 24 can be made of a metal such as a type 1150 alloy aluminum, or the tube assembly 24 can be made of fiber or plastic or other appropriate material, with the interior of the tube assembly 24 being rendered reflective by means of, e.g., electroplating, anodizing, metalized plastic film coating, or other suitable means.

In one preferred embodiment, the tube assembly 24 includes a cylindrical hollow lower tube segment 26 that is telescopically received in a cylindrical hollow upper tube segment 28, with the upper tube segment 28 in turn being engaged by means known in the art with the flashing 22. The tube segments 26, 28 can be held together by taping the joint 30 that is established between the segments 26, 28. Even when taped, the segments 26, 28 can move axially relative to each other to absorb thermal stresses. An expansion seal (not shown) such as the one described in co-pending U.S. Pat. application Ser. No. 08/969,923, owned by the present assignee and incorporated herein by reference, can be positioned radially between the segments 26, 28 to permit longitudinal (i.e., axial) relative motion between the segments 26, 28, while establishing a seal between the segments 26, 28.

FIGS. 1 and 2 best show the present inventive combination for coupling the lower tube segment 26, which defines a circular cross-section, with the rectangular opening 18*a* that is defined by the ceiling grid 14. A hollow adaptor 30 defines an inside surface 32, and the inside surface 32 is covered with a reflective coating 33, as is the case with the assembly 24. Furthermore, the adaptor 30 includes a ring-shaped tube segment 34 that is configured complementarily to the tube assembly 24 and that is engaged therewith by, e.g., taping or other means. By "configured complementarily" is meant that the tube segment 34 has the same shape (e.g., circular) and approximately same diameter (e.g., twenty inches) as the tube assembly 24. As can be appreciated in reference to FIG. 2, the preferred tube segment 34 has a vertical wall 36.

Additionally, the adaptor 30 includes a rectangular-shaped ceiling segment 38 that is configured complementarily to the rectangular opening 18*a* and that is coupled to the grid 14. In three dimensions, the ceiling segment 38 is a parallelepiped, and when the opening 18*a* is square, the ceiling segment 38 likewise defines a square cross-section. A rectangular-shaped light diffuser 40 covers the bottom of the ceiling segment as shown, it being understood that either the light diffuser 40, or ceiling segment 38, or both can be attached to the grid 14. The preferred method of coupling the adaptor 30 with light diffuser 40 to the grid 14 is discussed in greater detail below with reference to FIG. 4.

As recognized by the present invention, were the tube segment 34 contiguous to the ceiling segment 38, the light passing through the diffuser 40 would not appear to pass through the entire rectangular area of the diffuser 40 as desired, but instead would appear as a circular pattern covering only part of the area of the diffuser 40. This would render an artificial and undesirable appearance.

Accordingly, a hollow intermediate segment 42 is provided to connect the ring-shaped tube segment 34 to the rectangular-shaped ceiling segment 38, and to reflect light passing through the intermediate segment to more evenly distribute light transmission through the diffuser 40 than would otherwise occur without the intermediate segment 42. As shown in FIGS. 2 and 3, the intermediate segment 42 includes an upper intermediate portion 44 that defines a circular top edge 46. The top edge 46 of the upper intermediate portion 44 is closely received in the tube segment 34 as shown, although if desired the tube segment 34 could be received in the upper intermediate portion 44.

Additionally, a lower intermediate portion 48 that preferably defines, apart from its faceted edges, a right regular pyramidal frustum extends down from the upper intermediate portion 44. Being a right regular pyramidal frustum, the lower intermediate portion 48 defines four walls that terminate in a square that is juxtaposed with the upper periphery of the ceiling segment 38. To establish the round upper intermediate portion 44, the edges 49 of the lower intermediate portion 48 are faceted as shown in accordance with sheet metal transition principles known in the art.

FIG. 4 shows one method for coupling the adaptor 30 and diffuser 40 to the grid 14, it being understood that other methods can be used. As shown, the adaptor 30 is formed with a skirt 50 that rests on a horizontal portion 52 of one or more joists 17. If desired, a resilient seal 54 can be sandwiched between the adaptor 30 and joist 17 as shown.

Additionally, the diffuser 40 can include a diffuser plate 56 that is supported in a diffuser housing 58, and one edge of the diffuser housing 58 is pivotably attached to either the grid 14 or, more preferably, to the adaptor 30. The opposite edge of the diffuser housing 58 is held by means of clips to the adaptor 30, with the diffuser 40 thus being held to the adaptor 30 (or grid 14) in the same manner that a conventional ceiling tile is held to a ceiling grid. Alternatively, the adaptor 30 can be suspended from wires such that the bottom end of the ceiling segment 38 of the adaptor 30 is disposed in the periphery of the opening 18*a*. In any case, both the adaptor 30 and diffuser 40 are coupled, directly or indirectly, to each other and to the grid 14, with the diffuser plate 56 covering substantially all of the bottom opening of the adaptor 30.

While the particular TUBULAR SKYLIGHT WITH ROUND-TO-SQUARE ADAPTOR as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more".

What is claimed is:

1. A tubular skylight for a building having a roof with a skylight flashing and at least one ceiling grid below the roof for supporting a ceiling above a room, the ceiling grid defining at least one rectangular opening, the skylight comprising:

a transparent cover engageable with the flashing;

a tube assembly depending downwardly from the flashing and having an upper end covered by the cover, the tube assembly defining a round cross-section;

an adaptor coupling the tube assembly to the rectangular opening, wherein the adaptor defines a ring-shaped tube segment configured complementarily to the tube assembly and engaged therewith and a rectangular-shaped ceiling segment configured complementarily to the rectangular opening and coupled to the grid, the adaptor also including an intermediate segment at least partially frusto-pyramidal shaped connecting the ring-shaped tube segment of the adaptor to the rectangular-shaped ceiling segment of the adaptor.

2. The skylight of claim 1, wherein the adaptor is hollow and defines an inside surface, and the inside surface is covered with a reflective coating.

3. The skylight of claim 1, further comprising a rectangular-shaped light diffuser coupled to the rectangular-shaped ceiling segment of the adaptor.

4. The skylight of claim 1, wherein the intermediate segment includes a lower intermediate portion defining a right regular pyramidal frustum and an upper intermediate portion defining a circular top edge.

5. The skylight of claim 4, wherein the lower ceiling segment defines a square.

6. A method for mounting a tubular skylight including at least one tube in a building having a roof and at least one ceiling grid below the roof, comprising the acts of:

attaching the skylight to the roof;

disposing a diffuser in an opening of the grid; and coupling the tube of the skylight to the diffuser by interconnecting the tube and diffuser using an adaptor defining a circle, a rectangle, and a frusto-pyramidal portion therebetween, wherein the adaptor defines a ring-shaped tube segment configured complementarily to the tube assembly and engaged therewith and a rectangular-shaped ceiling segment configured complementarily to the rectangular-opening and coupled to the grid, the adaptor also including an intermediate segment at least partially frusto-pyramidal shaped connecting the ring-shaped tube segment of the adaptor to the rectangular-shaped ceiling segment of the adaptor.

7. The method of claim 6, wherein the adaptor includes:

a hollow tube segment, the tube segment being circular-shaped to facilitate coupling the tube segment to the tube; and a hollow ceiling segment, the ceiling segment being rectangular-shaped to facilitate coupling the ceiling segment to the grid.

8. The method of claim 7, further comprising the act of rendering the adaptor highly reflective.

9. The method of claim 7, wherein the adaptor further comprises:

an intermediate segment including a lower intermediate portion defining a right regular pyramidal frustum and an upper intermediate portion defining a circular top edge.

* * * * *